US005080181A

United States Patent [19]

Tatsuno

[11] Patent Number: 5,080,181

[45] Date of Patent: Jan. 14, 1992

[54] PRESSURE DETECTING DEVICE FOR TORQUE CONTROL WRENCH

[75] Inventor: Koji Tatsuno, Osaka, Japan

[73] Assignee: Uryu Seisaku, Ltd., Osaka, Japan

[21] Appl. No.: 523,554

[22] Filed: May 15, 1990

[51] Int. Cl.[5] ..... B25Q 5/06

[52] U.S. Cl. ..... 173/93.5; 137/462; 192/56 F; 464/25

[58] Field of Search ..... 173/12, 93, 93.5; 137/462; 192/.034, 56 F; 464/25

[56] References Cited

U.S. PATENT DOCUMENTS

| | | | |
|---|---|---|---|
| 3,116,617 | 1/1964 | Skoog | 173/93 |
| 4,418,764 | 12/1983 | Mizobe | 173/12 |
| 4,492,146 | 1/1985 | Workman, Jr. | 173/12 |
| 4,553,948 | 11/1985 | Tatsuno | 173/93.5 |

*Primary Examiner*—Mark Rosenbaum
*Assistant Examiner*—Allan M. Schrock
*Attorney, Agent, or Firm*—Wenderoth, Lind & Ponack

[57] ABSTRACT

A pressure detecting device in a torque control wrench has a rotor to be rotated by high pressure air, an output shaft and a device for generating impulse torque with the use of oil pressure on the output shaft due to rotation of the rotor. The device has a liner rotated by the rotor rotatably mounted on the output shaft. The device forms a high pressure chamber and a low pressure chamber in the liner for the generation of impulses on the output shaft, and has a hole therein having first and second ports communicating with the high and low pressure chambers, respectively. A valve is disposed in the hole for adjustably regulating the flow of oil from the first port to the second port and for generating a shut-off signal. The valve has a valve shaft adjustably mounted in the hole, having a passage therein communicating with the high pressure chamber. The passage has an opening at an end of the valve shaft. A relief valve is biased by a spring to close the opening of the passage and open upon the high pressure chamber reaching a set pressure. The liner has an end lid with a cylinder and a shut-off signal passage communicating the cylinder with the relief valve. A rod extends through the rotor and has a piston at an end thereof disposed in the cylinder, the opposite end of said rod being provided with a shut-off valve mechanism.

4 Claims, 6 Drawing Sheets

UX-T1400 (OIL PRESSURE CORRESPONDING TYPE) TIGHTENING TEST
(TESTING CONDITIONS)

PRESSURE DETECTING DEVICE FOR TORQUE CONTROL WRENCH

BACKGROUND OF THE INVENTION

1. Field of the Invention

This invention relates to a device for detecting pressure in a torque control wrench which is simple in construction and yet carries out precise detecting.

2. Description of the Prior Art

A shutoff mechanism, by which, when a set pressure is reached air supply to a motor is suspended to stop a wrench, is generally adopted for the torque control wrenches. According to this shutoff mechanism, a small hole communicating with a high pressure chamber of a liner is at an upper lid of the liner. A piston is moved inside the upper lid of the liner by the rise in pressure in the liner chamber upon the generation of pulse. A self-holding type detecting valve works in linkage with the piston. A timer circuit works in response to the detecting valve and a main valve is shut after the lapse of a certain preset period of time so as to stop working of a wrench.

However, when the above piston is moved by the rise of pressure, a spring pressure for returning the piston is always acting on the piston. The internal pressure at the time of the pulse is high and it is difficult to work out a spring design to cope with such an internal pressure. Theoretically, it is possible to change the timing of oil pressure detection by regulation of a spring but substantially, regulation of the timing is impossible. Since a timer operates after a preset pressure is reached, the tightening torque varies with variation of the state of the tightening work, and accordingly the tightening torque becomes unbalanced. Moreover, it becomes necessary to regulate the tightening time by means of output regulation by a relief valve shaft and a timer.

The present invention has for its object to dispense with the timer control, to equalize tightening torque and to carry out pressure detection precisely.

SUMMARY OF THE INVENTION

In order to attain the above object, the present invention has the following construction.

A passage, in which a part of the pressure oil on the side of a liner high pressure chamber flows, is formed in a relief valve shaft inserted adjustably in the liner. An opening surface of this passage is formed at an end of the relief valve shaft, and a relief valve, which is biased by a spring, is provided at this end surface so as to open the passage at a set pressure. This relief valve communicates with a cylinder through the medium of a relief valve inserting hole made in the liner and a passage formed at an upper lid of the liner. A piston provided at a forward end of a rod which passes through a rotor shaft is put in the cylinder inside the upper lid of the liner and a shutoff valve mechanism is provided at the other end of the rod.

BRIEF DESCRIPTION OF THE DRAWINGS

The nature and advantage of the present invention will be understood more clearly from the following description with reference to the accompanying drawings, in which.

DETAILED DESCRIPTION OF THE INVENTION

Figure 1:
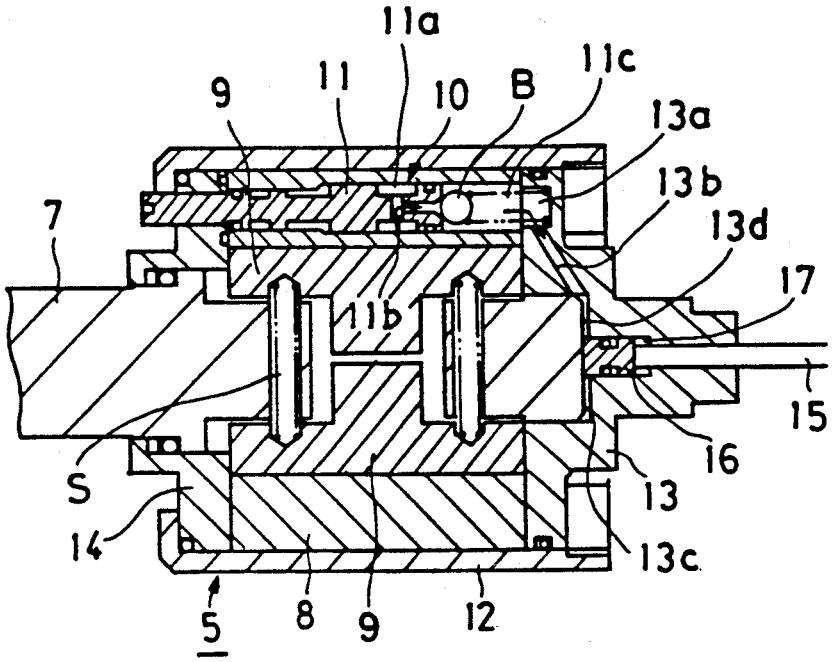
FIG. 1 is a front view, in vertical section, of a pressure detecting device according to the present invention.

In the drawing, reference numeral 1 denotes a main body of an oil pressure type torque wrench, in which a main valve 2 for supplying and stopping the supply of high pressure air and a valve 3 for switching between forward and reverse turning are provided. A rotor 4 is provided in the main body 1 so that high pressure air from the above valves generates rotational torque. The main body 1 has a motor construction of a general pneumatic tool.

An oil pressure type impulse torque generator 5, which converts rotational torque of the rotor 4 into impulse torque, is provided in a front casing 6, which protrudes at a forward end portion of the main body 1.

The oil pressure type impulse torque generator 5 has a liner 8 whose inner calibre is eccentric to a main shaft 7 within a liner casing 12, which liner is rotatably mounted on the main shaft 7. Working oil for generating torque in the liner 8 fills the liner 8, which is sealed. Two opposing blade inserting grooves 7*b* are formed on a diametrical line passing through the center of the main shaft 7. Inserted in the grooves 7*b* are two respective blades 9 having a thickness smaller than the width of the groove, the blade 9 being biased by a spring S to project radially outwardly toward the outer circumference of the main shaft 7. Seal points (surfaces) 7*a*, which project slightly from the outer end surface of the main shaft 7, are formed at the outer circumferential surface between the two blades 9. A straight line connecting the two seal points 7*a* is shifted by a certain spacing from a straight line which is in parallel with it and passes through the center of the main shaft, so that a desired angle may be formed between the center line and a straight line connecting the center of the main shaft and a seal point.

Figure 2:
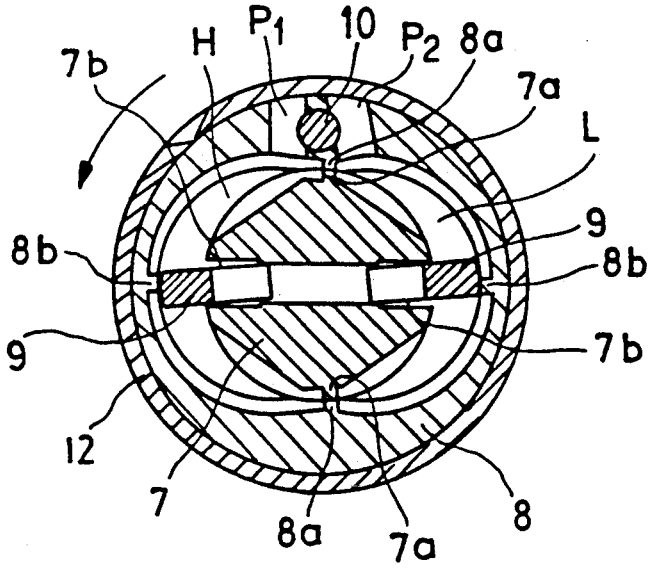
FIG. 2 is a side view, in vertical section, of the pressure detecting device of FIG. 1.
Figure 3:
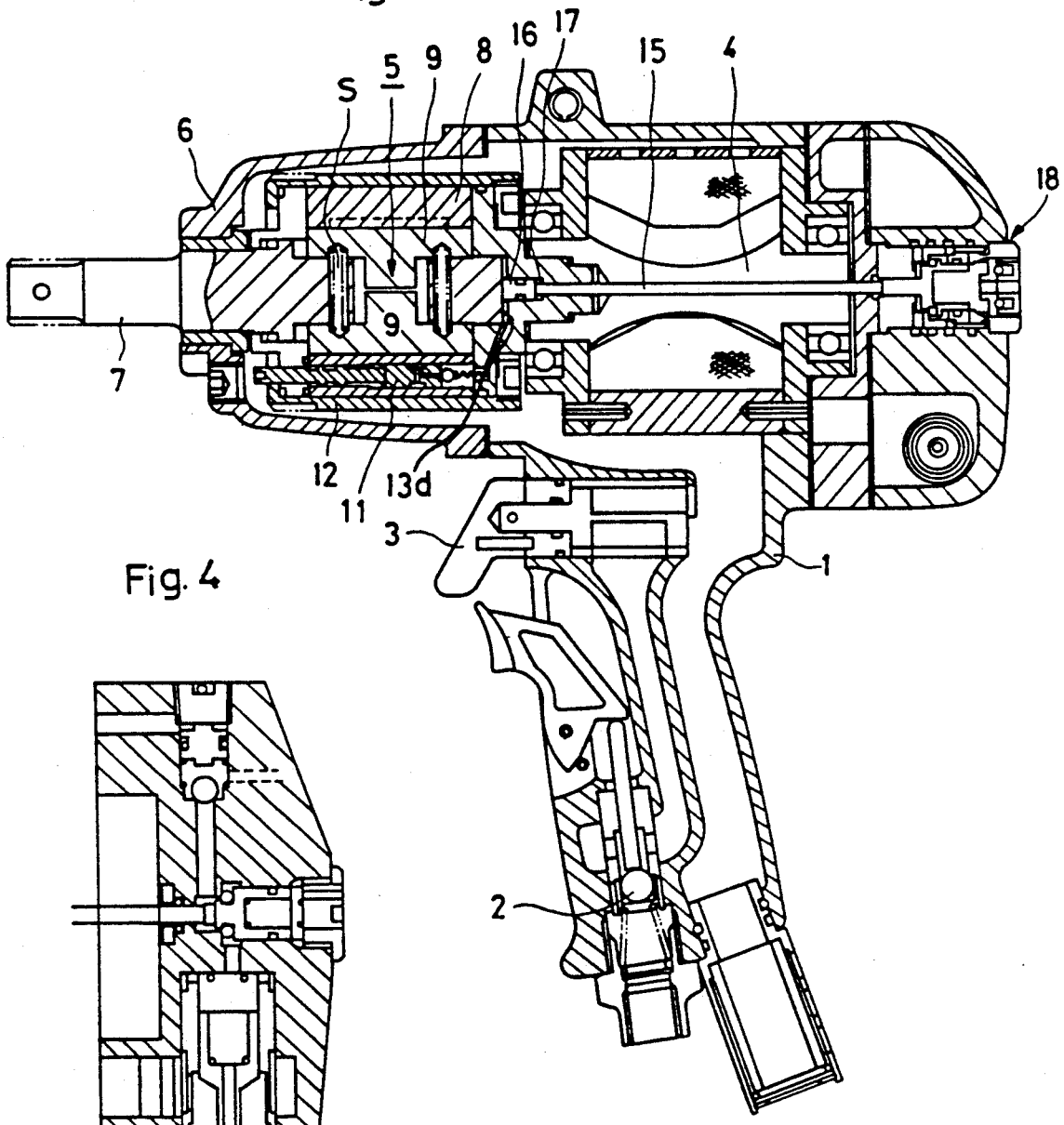
FIG. 3 shows an embodiment of a torque control wrench.
Figure 4:
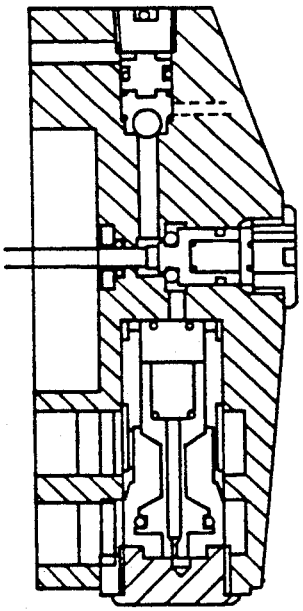
FIG. 4 shows a different embodiment of a shutoff valve mechanism.

The liner 8, in which is fitted the main shaft 7 carrying the two blades 9 in such a fashion that they project in opposite directions, forms liner chambers of eyebrow-shape in cross section, as shown in FIG. 2. The circumferential surfaces of opposing constricted portions of the liner 8 are projected in cone-shapes from the inner circumferential surfaces of other portions of the liner 8 so as to form seal points 8*a* and 8*b*. Among the seal points 8*a* and 8*b* provided on the inner circumferential surface of the eliptical cavity, two seal points 8*b* opposing in the direction of the line of apsides are on a straight line which passes through the center of the cavity. The other two seal points 8*a*, opposing in the direction of the minor axis, are on a straight line which is shifted by a certain spacing from the line of the minor axis passing through the center of the cavity, and is in parallel with it. It is determined so that a required angle is formed by the line of the minor axis of the cavity and a straight line connecting the center of the cavity and a seal point 8*a*. Therefore, regarding the space between seal points 8*a* and 8*b* (in the direction of cavity circumference), corresponding spaces between seal points on both sides of the line of apsides are equal but corresponding spaces between seal points on both sides of the line of the minor axis are unequal. When the liner 8 revolves around the outer circumference of the main shaft 7 inserted in the liner chamber, the seal point 8*a* makes contact with or approaches the seal point 7*a* of the main shaft 7, whereby the liner chamber is divided into two chambers, which are sealed hermetically, by the seal points 7*a* and 8*a*. Formed intermediately of the opposing seal points 8*a* are cone-shaped seal points 8*b* which temporarily divide the liner chamber into two or four chambers by contacting with the extreme ends of the blades 9. These seal points 8*b* are provided opposite to each other with their centers on a straight line passing the center of the liner chamber. An output adjusting valve inserting hole 10 is made at one of the seal point 8*b* parts of the liner 8, in parallel with the liner chamber, i.e., in parallel with the axis of rotation of the liner. Ports $P_1$ and $P_2$ are formed at the innermost part of the hole 10 so that at least two chambers divided by the seal points 8*a* of the main shaft 7 and the blades 9 communicate with each other. A relief valve shaft 11 and a relief valve B, which effect output regulation, are fitted adjustably in the hole 10.

The relief valve shaft 11 is screwed into a lower lid 14 of the liner and is rotatably adjustable from the outside of the lower lid 14. A groove 11*a* is formed an the outer circumference of the relief valve shaft 11, from which a passage 11*b* which opens to and communicates with an end surface of the relief valve shaft 16. A relief valve B is provided at the opening of the end surface of the relief valve shaft 11 in such a fashion that it is pressed by spring pressure. This relief valve B is biased to the side of the relief valve shaft 11 by a spring 11*c* fixed in a cavity 13*a* formed in an upper lid 13 of the liner.

A hole is made along the axis of rotation of the rotor 4 and a rod 15 is inserted slidably in this hole. A piston 16 provided at a forward end of the rod 15 is fitted in a cylinder 17 provided inside the upper lid 13 of the liner 8. A forward end of the piston 16 is opposed to an end surface of the main shaft 7 which is opposite to the upper lid 13 of the liner. The end surface of the main shaft 7 is inserted in a cavity 13*c* of the upper lid 13 of the liner 8, and a minute gap is formed between the inner bottom surface of the cavity 13*c* and the end surface of the main shaft 7, and thus a cylinder 13*d* for pressure detection is formed. A small passage 13*b* connects the cylinder 13*d* with the cavity 13*a* of the upper lid 13 of the liner 8. Provided at the other end of the rod 15 is a shutoff valve mechanism 18 which is operated by the movement of the rod 15.

Under the above construction, when pressure air is introduced into the rotor chamber in the main body 1 by operation of the main valve 2 and the switch valve 3, the rotor 4 revolves at high speed. The rotational force of the rotor 4 is transmitted to the liner 8 provided at the rotor shaft. This liner 8 is supported rotatably at its outer circumference by a tubular liner casing 12. The upper lid 13 and the lower lid 14 of the liner are provided at both end surfaces of the casing 12 so that working oil filled in the liner chamber is hermetically sealed. By the rotation of the liner 8, the cross-sectional shape of the liner chamber changes. At the time of impulse, the seal points 7*a* of the main shaft and the blades 9 respectively contact the seal points 8*a* and 8*b* of the liner 8, the liner chamber is divided into two chambers, left and right, with the opposing blades 9 therebetween, and the left chamber and the right chamber are further divided vertically into a high pressure chamber H and a low pressure chamber L by the contacting seal points 7*a* and 8*a*. Thus, the high pressure chamber H and the low pressure chamber L are formed substantially on both sides of the blades. With the rotation of the liner 8 by the rotation of the rotor 4, of the two chambers divided by the seal point 7*a* of the main shaft 7 and the seal points 8*a* on the liner side, a high pressure chamber H decreases in volume but a low pressure chamber increases in volume, just before the moment of impulse. And when the two chambers with blades therebetween are put in a perfectly sealed state, high pressure is generated at the high pressure chamber and such oil pressure presses momentarily the side of the blade 9 to the side of the low pressure chamber, whereupon such impulse is transmitted to the main shaft in which blades are fitted, and thus the desired intermittent torque is generated at the main shaft, which is rotated to effect the required work. After the torque is generated at the main shaft 7 by the impulse of the blade 9, further rotation of the liner makes the high pressure chamber H and the low pressure chamber L communicate with each other to define one chamber. Thus, the overall liner chambers are divided only into two chambers of the same pressure and no torque is generated in the main shaft, but the liner rotates further by the rotation of the rotor. When the liner rotates further by 90 degrees, namely, rotates through 180 degrees from the time of the impulse, a gap is caused between the seal points 7*a* and 8*a* because the opposing seal points 8*b* of the liner 8 and the seal points 7*a* of the main shaft are shifted by several degrees from the straight line passing through the center and the liner chamber is divided into two chambers, right and left, by the main shaft and upper and lower blades 9. At this time, the change in pressure is observed throughout the whole chamber and the liner rotates freely. The state in which further rotation of the liner through 90 degrees or 270 degrees from the time of the impulse, is substantially the same as the state in which the liner rotated through 90 degrees. Only the position of the output regulating valve is turned upside down. If the liner turns further than this state, the liner chamber which was divided into two, right and left, with each blade therebetween, is divided further into four, by each blade and the seal points 8*b* on the liner side and also by contact of both seals 7*a* and 8*a* on the liner side, namely, into two high pressure chambers and two low pressure chambers with a blade therebetween. Thus, there is caused a difference in pressure between the two, whereby an impulse is generated at each rotation of the liner. In this way, each rotation of the liner produces one impulse.

In the oil pressure type impulse torque generator 5, when high pressure is generated by rotation of the liner 8, working oil flows from the high pressure chamber H to the low pressure chamber L via the port $P_1$, the relief valve B in the hole 10 and the port $P_2$. At this time, the relief valve B is pressed against the end surface of the relief valve shaft 11 by spring pressure until the pressure in the high pressure chamber H reaches the preset pressure and this pressure is not detected. However, when the pressure rises up to the level of the preset pressure and a pulse is generated, the pressure in the high pressure chamber which has risen to the level of the preset pressure flows from the port $P_1$ to the port $P_2$, and a part of the pressure opens the relief valve against the force of the spring 11*c*, whereby a part of the working oil is introduced into the cylinder 13*d* via the passages 11*b* and 13*b*, and the pressure acts on the piston 16, with the result that the rod 15 is moved, the shutoff valve mechanism 18 is operated and a set pressure is detected.

Regulation of impulse is effected by regulating the pressing force of the relief valve B (which is biased by the spring 11*c*) by rotating the relief valve shaft 11 and by closing passages $P_1$ and $P_2$.

Figure 5:
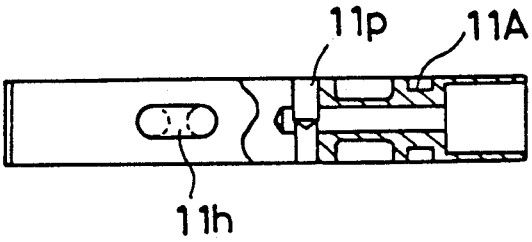
FIG. 5 is a front view of a relief valve shaft, partly broken down.
Figure 14:
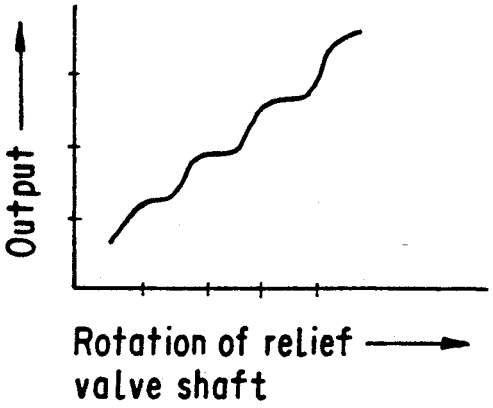
FIG. 14 is a graph showing the relation between a turning angle of a relief valve shaft and the output.

In the above case, as shown in FIG. 14, output is not in proportion to the rotation of the relief valve shaft, and regulation becomes difficult. In order to avoid such trouble, as shown in FIG. 5, etc., the relief valve shaft 11 is divided into a main body 11A and a regulating rod 11B, so that even if the regulating rod 11B is turned, the main body side of the relief valve shaft does not rotate but only reciprocates. For example, a slot groove 11*h* is formed in the axial direction on the main body 11A and a knock pin 11N is inserted in the groove 11*h*, whereby the main body side 11A is prevented from rotating.

Figure 7:
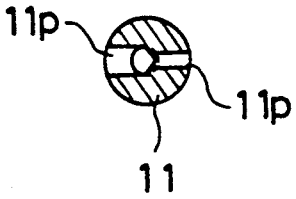
FIG. 7 is a side view, in vertical section, of the relief valve shaft.
Figure 6:
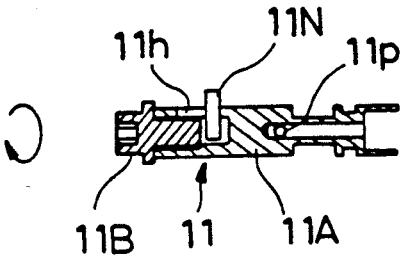
FIG. 6 is a front view, in vertical section, of the relief valve shaft.
Figure 8:
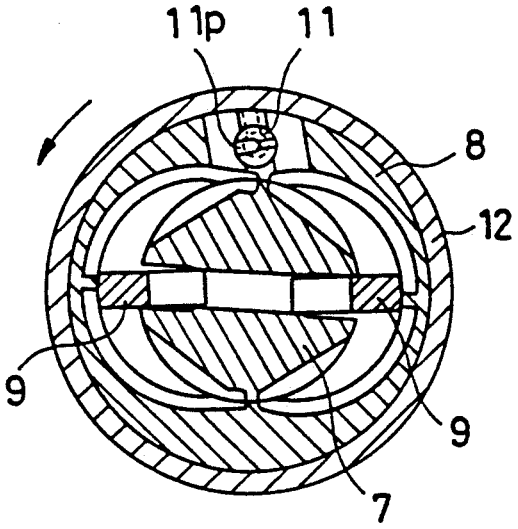
FIG. 8 is a side view, in vertical section, of a torque control wrench using the relief valve shaft shown in FIG. 5.

In a low output type machine and a small type machine, branched pressure from high pressure to low pressure is generally low. In order to improve it, as shown in FIGS. 7 and 8, an orifice 11*p* whose opening calibre is large at one side and small at the other side is provided.

Figure 9:
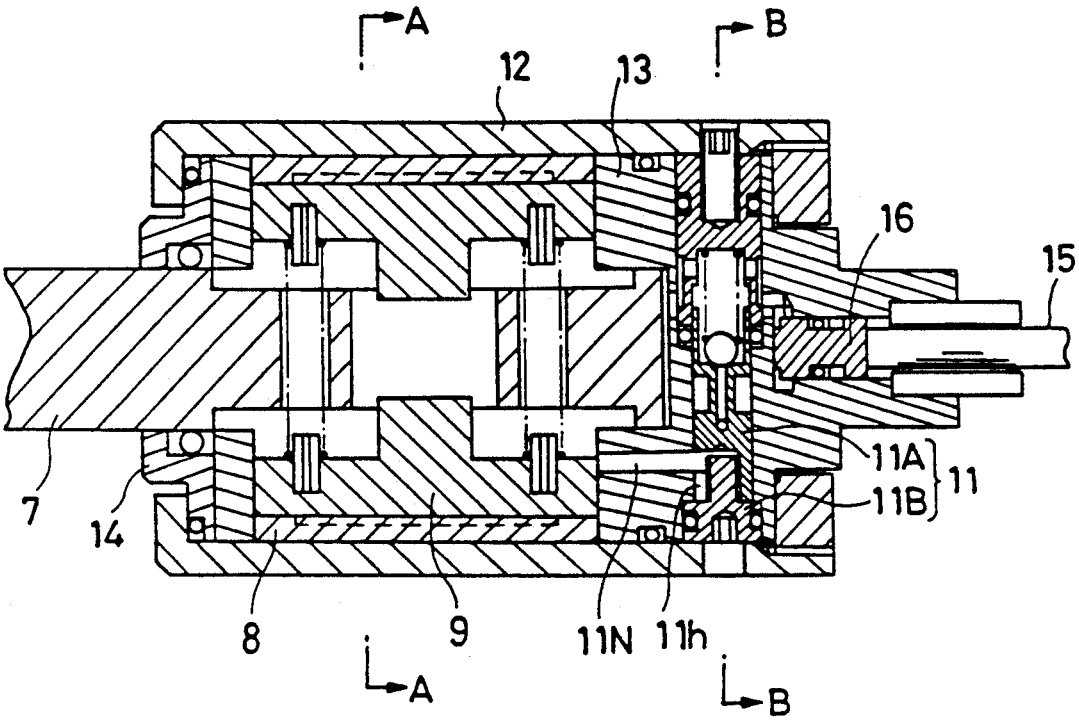
FIG. 9 is a front view, in vertical section, of an embodiment in which a relief valve shaft is provided at an upper lid of a liner.
Figure 11:
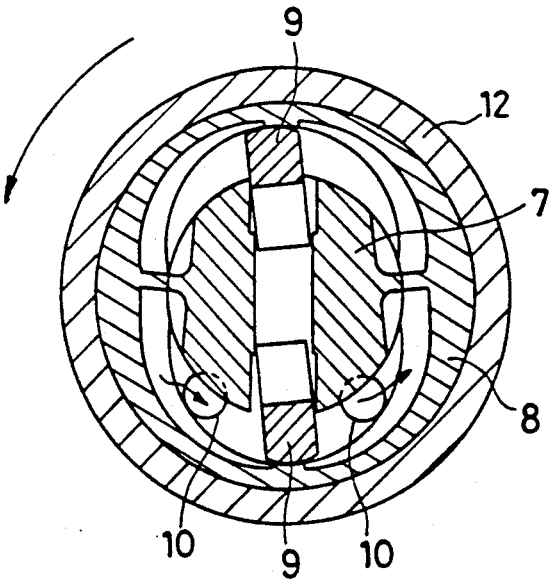
FIG. 11 is a side view, in vertical section, of a blade part of the liner of FIG. 9.
Figure 10:
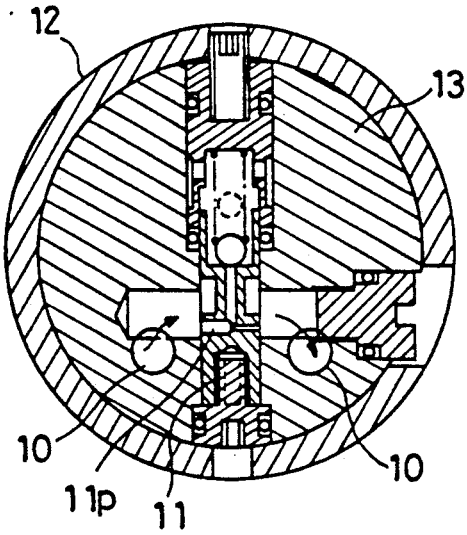
FIG. 10 is a side view, in vertical section, of the upper lid part of the liner of FIG. 9.
Figure 12:
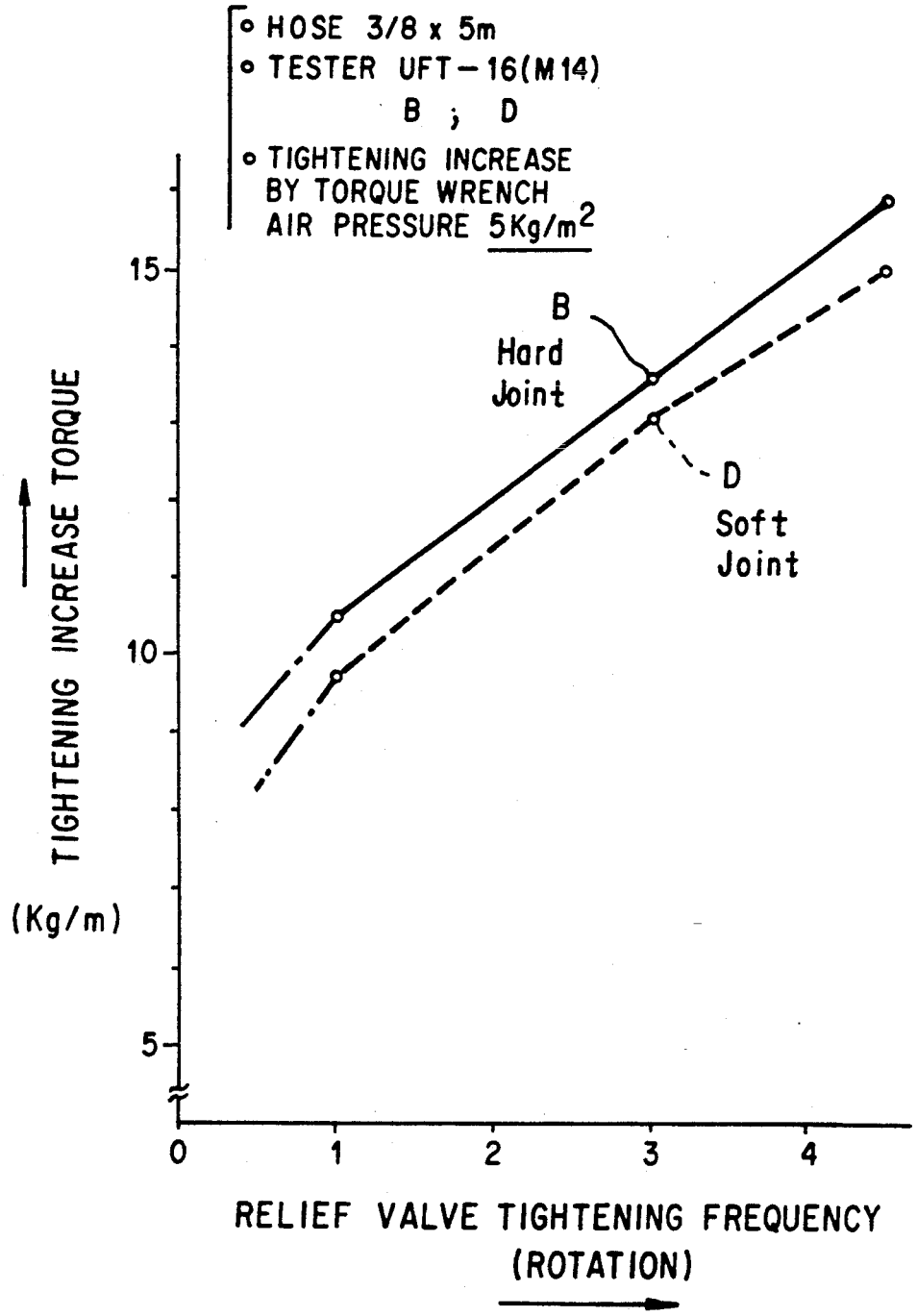
FIG. 12 and FIG. 13 are graphs of a tightening test.
Figure 13:
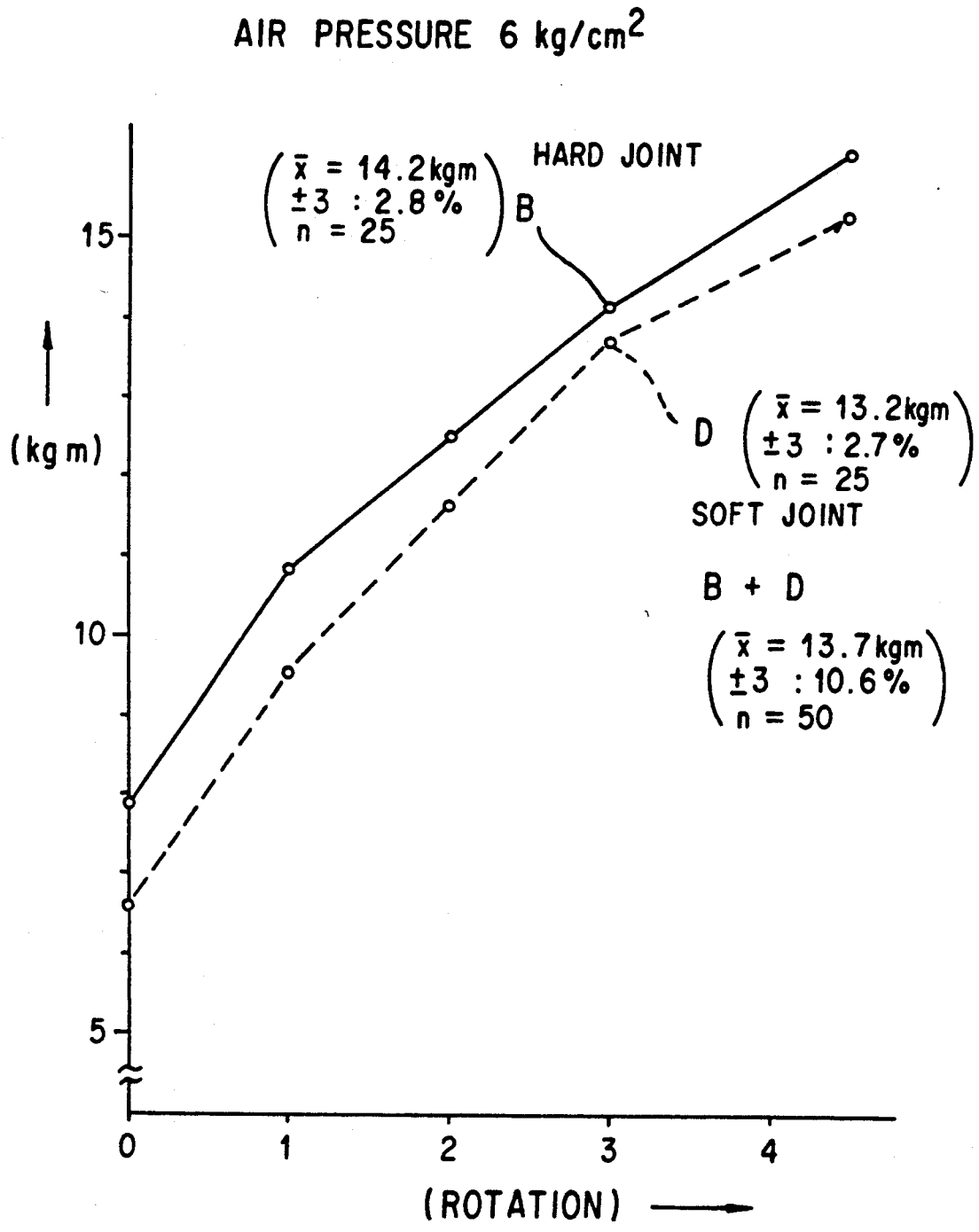

It is possible to provide the relief valve shaft 11 inside the upper lid of the liner on the rear end side of the torque generator as shown in FIG. 9 and FIG. 10. By providing the relief valve shaft inside the upper lid of the liner, it becomes possible to lessen the outside diameter of the liner, and also the concentricity of relief valve shaft holes of the lower lid of the liner becomes unnecessary.

Application of the above device for pressure detecting is not limited to two-blade type oil pressure impulse torque.

According to the present invention, a passage, in which a part of pressure oil on the side of the liner high pressure chamber flows, is formed in a relief valve shaft inserted adjustably in the liner. An opening surface of this passage is formed at an end of the relief valve shaft, and a relief valve which is biased by a spring is provided at this end surface so as to open the passage at a set pressure. This relief valve communicates with a cylinder through the medium of a relief valve inserting hole made in the liner and a passage formed at an upper lid of the liner. A piston provided at a forward end of a rod which passes through a rotor shaft is put in a cylinder inside the upper lid of the liner and a shutoff valve mechanism is provided at the other end of the rod.

Under the above construction, the pressure to be detected is not high and the spring design is easy because of the small hole diameter of the passage. Moreover, even if the state of tightening work changes, a tool does not stop until a set torque is reached, and the precision of the tightening torque can be maintained. Regulation of the torque can be done only by the relief valve shaft, and therefore a timer controller is not necessary. Thus, miniaturization and lighter weight of the machine can be realized.

Although the relief valve shaft is slidable in the direction of the line of apsides in the passage made inside the liner or the upper lid of the liner, it is so designed that the relief valve shaft does not rotate and therefore the flowing direction of branched oil can be kept constant in relation to the flow of oil for detecting. Also, since the orifice which serves as a passage for signal oil and is made in the relief valve shaft has a calibre which is larger on its high pressure side than its low pressure side, it is possible to keep branched oil pressure at the required detectable pressure and thus accurate detecting can be carried out. Moreover, even if air pressure used on the tool side changes, output (torque) does not change and thus detecting precision is improved.

What is claimed is:

1. A pressure detecting device in a torque control wrench, comprising:

a rotor to be rotated by high pressure air;

an output shaft;

a means for generating impulse torque with the use of oil pressure on said output shaft due to rotation of said rotor, said means comprising a liner rotated by said rotor rotatably mounted on said output shaft and having oil therein, said means forming a high pressure chamber and a low pressure chamber in said liner for the generation of impulses on said output shaft, and said means further comprising a hole in said liner having first and second ports communicating with said high and low pressure chambers, respectively; and a valve means disposed in said hole for adjustably regulating the flow of oil from said first port to said second port and for generating a shut-off signal, said valve means comprising a valve shaft adjustably mounted in said hole having a passage therein communicating with said high pressure chamber, said passage having an opening at an end of said valve shaft, a relief valve being biased by a spring to close said opening of said passage and open upon said high pressure chamber reaching a predetermined set pressure;

said liner having an end lid with a cylinder and a shut-off signal passage communicating said cylinder with said relief valve;

a rod extending through said rotor and having a piston at an end thereof disposed in said cylinder, the opposite end of said rod being provided with a shut-off valve mechanism.

2. The pressure detecting device of claim 1, wherein said valve shaft comprises a rotatably adjustable regulating rod and a rotatably fixed valve shaft main body reciprocably moved by said regulating rod.

3. The pressure detecting device of claim 2, wherein said main body has a slot with a pin therein for maintaining said main body rotatably fixed.

4. The pressure device of claim 1, wherein said valve shaft has an orifice therein communicating with said passage for said shut-off signal and with said high pressure chamber and said low pressure chamber, said orifice being larger toward said high pressure chamber than said low pressure chamber.

* * * * *